United States Patent [19]

Aysta et al.

[11] 4,163,596

[45] Aug. 7, 1979

[54] ELECTRICAL CONNECTOR

[75] Inventors: James E. Aysta, Stillwater; Dewain R. Goff, St. Paul Park, both of Minn.

[73] Assignee: Minnesota Mining and Manufacturing Company, St. Paul, Minn.

[21] Appl. No.: 872,825

[22] Filed: Jan. 27, 1978

[51] Int. Cl.[2] ..... H01R 9/08

[52] U.S. Cl. ..... 339/97 P

[58] Field of Search ..... 339/97 R, 97 P, 98, 339/99 R

[56] References Cited

U.S. PATENT DOCUMENTS

| | | | |
|---|---|---|---|
| 3,183,472 | 5/1965 | Pawl | 339/97 P |
| 3,594,712 | 7/1971 | Enright et al. | 339/97 R |
| 4,059,331 | 11/1977 | Sedlacek | 339/97 P |

FOREIGN PATENT DOCUMENTS

| | | | |
|---|---|---|---|
| 1007316 | 3/1977 | Canada | 339/97 P |
| 2339041 | 2/1974 | Fed. Rep. of Germany | 339/97 R |

*Primary Examiner*—Joseph H. McGlynn

*Attorney, Agent, or Firm*—Cruzan Alexander; Donald M. Sell; Terryl K. Qualey

[57] ABSTRACT

A connector for insulated electrical wires in which a body of insulating material has a wire connection well formed into one surface and receives a slotted, flat plate, electrical contact element. A wire retention well is formed adjacent the wire connection well and is joined to the wire connection well by a passageway aligned with the slot in the contact element. The passageway is constricted to engage the insulation of a wire forced into the slot of the contact element in the wire connection well through the passageway and out of the wire retention well to electrically connect the wire to the contact element while providing strain relief for the wire in the passageway.

7 Claims, 4 Drawing Figures

ELECTRICAL CONNECTOR

FIELD OF THE INVENTION

The present invention relates to an electrical connector for connecting insulated wires and at the same time providing strain relief therefor to prevent the wire from being pulled out of the contact element.

BACKGROUND OF THE INVENTION

The prior art is replete with electrical connectors utilizing slotted electrical contact elements which strip insulation from an insulated wire and make electrical connection to the wire. Such connectors are disclosed for example, in U.S. Pat. Nos. 3,239,796; 3,434,093; 3,444,506; 3,920,301; 3,924,923; 3,977,754; 3,979,615; and 4,009,922. Generally, as illustrated in these patents, the wire path through the electrical connector passes in a straight line through the contact element. In many applications, to prevent deterioration of the electrical connection, the wire must be constrained on at least one side of the contact element to prevent strain on the wire which has been weakened by insertion into the contact element, and to prevent the wire from being pulled out of the slot of the contact element. Straight line wire connectors with strain relief are, however, very limited in the number of connections that may be made at one surface of the connector since an entire straight line across the surface of the connector is occupied in connecting a single wire.

SUMMARY OF THE INVENTION

The present invention provides a connector for insulated electrical wires comprising a body of insulating material having a wire connection well formed into one surface to receive a slotted, flat plate, electrical contact element and to closely support the outside edges of the legs of the contact element. A wire retention well is formed into the surface of the body adjacent the wire connection well for receipt of an insulated wire to be connected and a passageway joins the wire retention well to the wire connection well, the passageway extending from the surface of the body and being aligned with the position of the slot in a contact element supported in the wire connection well. The passageway is constricted to engage the insulation of a wire to be connected by a contact element in the wire connection well. A slotted, flat plate, electrical contact element is positioned in the wire connection well of the body with the open end of its slot adjacent the surface of the body to receive and strip insulation from an insulated wire forced into the wire connection well. In use, an insulated wire is forced into the slot of the contact element in the wire connection well and simultaneously into the passageway and the wire retention well and is then bent and exits from the connector from the wire retention well. The contact element, closely supported by the walls of the wire connection well, effectively strips insulation from the wire to make electrical contact to the wire while the passageway walls engage the wire insulation and the wire is bent in passing from the passageway and out of the wire retention well to provide strain relief for the connected wire.

THE DRAWING

Figure 1:
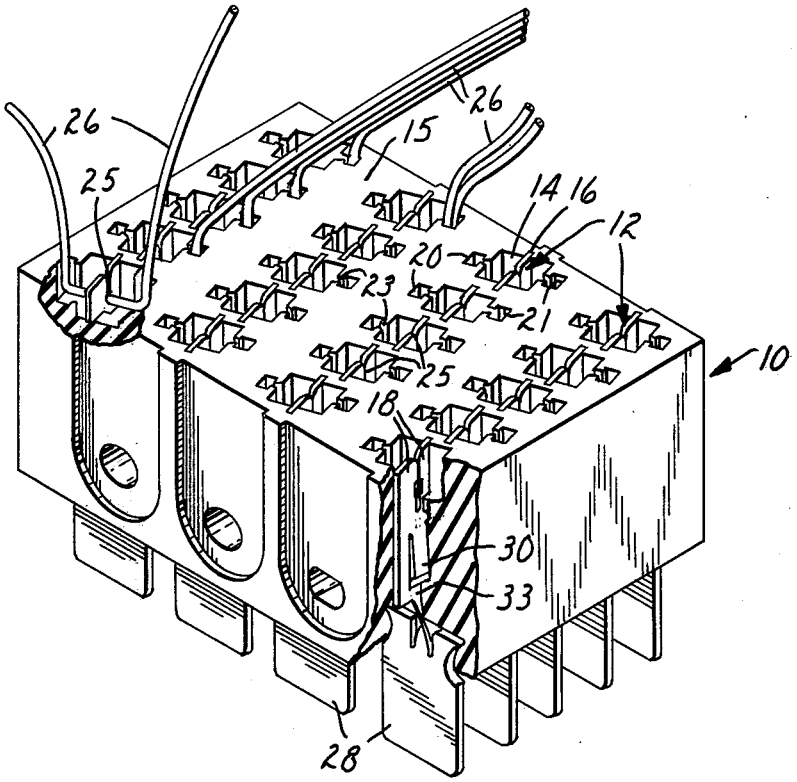
FIG. 1 is a perspective view, partially in section, of an electrical connector constructed in accordance with the present invention.
Figure 2:
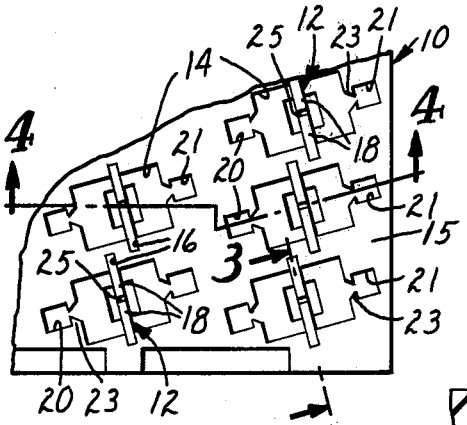
FIG. 2 is a partial plan view of the electrical connector of FIG. 1.
Figure 3:
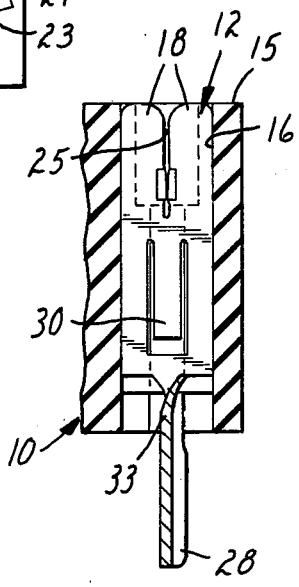
FIG. 3 is a cross sectional view taken generally along line 3—3 of FIG. 2.
Figure 4:
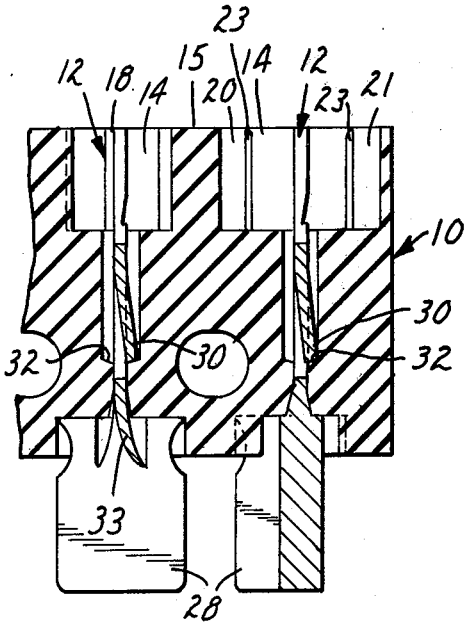
FIG. 4 is a cross sectional view taken generally along line 4—4 of FIG. 2.

The electrical connector of the present invention comprises a body 10 of insulating material and at least one slotted, flat plate, spring compression reserve electrical contact element 12.

The body 10 is formed with wire connection wells 14 formed into one surface 15. The wire connection wells 14 are all the same and each is formed to receive a contact element 12. The illustrated wire connection wells 14 are rectangular in cross section and two opposed walls are formed with recesses 16 to define a slot across the wire connection well for reception of a slotted flat plate contact element 12 with the edges of the legs 18 of the element in the recesses 16 and closely adjacent the vertical walls of the recesses 16 so that the outside edges of the legs of the contact element 12 are closely supported.

Two similar wire retention wells 20 and 21 are formed into the surface 15 of the body 10, one adjacent each of the opposed walls that do not have the recesses 16. Similar passageways 23 extending into the surface 15 of the body 10 connect each of the wire retention wells 20 and 21 to a wire connection well 14. The passageways 23 are aligned with the slot 25 in the contact element 12 and are constricted to engage the insulation of a wire 26 to be connected by a contact element 12 in a wire connection well 14.

In the illustrated embodiment, the connector is formed with a plurality of wire connection wells 14 arranged in four parallel rows and five parallel columns that are perpendicular to the rows. The connector wells 14 are turned at an angle to the rows and columns so that the flat plate contact elements 12 are at an angle of about 15° to the rows and columns to more efficiently utilize the space on the surface 15 of the connector while providing sufficient material between wire connection wells 14 to support the outside edges of the legs 18 of the contact elements 12.

The illustrated connector body is apertured at the base of each of the wells 14 through the body and the contact elements 12 extend through the body and are formed at their ends opposite surface 15 as knife connector elements 28. These knife connector elements 28 are of the type illustrated in U.S. Pat. No. 2,664,552 for connection with fork elements such as illustrated and described in that patent. Between the slotted end and the knife connector end 28, each element 12 is formed with a central resilient tab 30 that deflects out of the plane of the contact element to engage a ledge 32 in the aperture through the body 10 when the element is inserted into the insulating body from the knife element surface to prevent removal of the element. To position the slotted ends of the elements in positions inclined to their rows and columns on surface 15 while positioning the knife elements in parallel rows and columns, the flat plate contact is twisted at 33 as it is inserted into the body aperture.

In use, an insulated wire may be forced into a wire connection well 14 by a tool that bridges the contact element 12 and simultaneously forces the wire into a passageway 23 and at least one wire retention well 20 or 21. The contact element 12 strips insulation from the wire 26 to make electrical contact to the wire while the walls of the passageway 23 engage insulation on the wire and the wire is bent in passing from the passageway and out of the wire retention well to provide strain relief for the connected wire. As illustrated in FIG. 1, one end of the wire 26 may be cut off in the wire connection well 14 so that the wire runs from the contact element through one passageway 23 and out of one wire retention well 20. Alternatively it may be desired to continue the wire to another connection in which case the wire may extend into one wire retention well 20 through the wire connection well 14 and out the other wire retention well 21 and be strain relieved in both passageways 23 and by the bends into and out of the wells 20 and 21.

We claim:

1. A connector for insulated electrical wire comprising:

a body of insulating material having a wire connection well formed into one surface to receive a slotted, flat plate, electrical contact element and to closely support the outside edges of the legs of the contact element, a wire retention well formed into said one surface adjacent said wire connection well for receipt of an insulated wire to be connected, and a passageway joining said wire retention well to said wire connection well, said passageway extending into said one surface of said body and being aligned with the position of the slot in a contact element supported in said wire connection well, said passageway being constricted to engage the insulation of a said wire to be connected by a contact element in said wire connection well; said wire connection well, said passageway and said wire retention well together defining a wire path from said wire connection well through said passageway into said wire retention well, then turning and exiting from said wire retention well through said one surface of said body, and a slotted, flat plate, electrical contact element in said wire connection well of said body with the open end of its slot adjacent said one surface of said body to receive and strip insulation from an insulated wire forced into said wire connection well, whereby an insulated wire may be forced into said wire connection well and simultaneously into said passageway and said wire retention well, said contact element stripping insulation from the wire to make electrical contact to the wire while the passageway walls engage the wire insulation and the wire is bent in passing from said passageway and out of said wire retention well to provide strain relief for the connected wire.

2. A connector as recited in claim 1 wherein there are two of said wire retention wells formed in said body joined to said wire connection well by passageways entering said wire connection well from opposite sides to permit a wire to be connected in said connection well to enter through one retention well and passageway and exit from the other passageway and retention well.

3. The connector of claim 1 wherein the opposed walls of said wire connecting well are recessed to provide a slot for reception of said contact element with the edges of the legs of the element in said recesses.

4. The connector of claim 1 wherein said body is formed with a plurality of said wire connecting wells, wire retention wells and joining passageways, and a said contact element is similarly positioned in each wire connecting well.

5. The connector of claim 4 wherein there are two of said wire retention wells formed in said body adjacent each of said wire connection wells, each pair of wire retention wells being joined to a wire connection well by passageways entering the wire connection well from opposite sides to permit a wire to be connected in the connection well to enter through one retention well and passageway and exit from the other passageway and retention well.

6. The connector of claim 4 wherein said plurality of wire connecting wells are arranged in parallel rows and parallel columns that are perpendicular to said rows.

7. The connector of claim 6 wherein said flat plate contact elements are positioned at an angle to said rows and said columns.

* * * * *